US008453384B2

(12) United States Patent
Boyer

(10) Patent No.: US 8,453,384 B2
(45) Date of Patent: Jun. 4, 2013

(54) CHILD SAFE DOOR, FRAME AND HINGE ASSEMBLY

(76) Inventor: George Akos Boyer, Blacktown (AU)

( * ) Notice: Subject to any disclaimer, the term of this patent is extended or adjusted under 35 U.S.C. 154(b) by 205 days.

(21) Appl. No.: 12/867,490

(22) PCT Filed: Sep. 21, 2009

(86) PCT No.: PCT/AU2009/001249

§ 371 (c)(1),
(2), (4) Date: Aug. 13, 2010

(87) PCT Pub. No.: WO2010/031140

PCT Pub. Date: Mar. 25, 2010

(65) Prior Publication Data

US 2010/0313484 A1 Dec. 16, 2010

(30) Foreign Application Priority Data

Sep. 19, 2008 (AU) ..... 2008904901

(51) Int. Cl.
*E06B 3/34* (2006.01)
*E06B 7/36* (2006.01)

(52) U.S. Cl.
USPC ..... 49/383; 49/398

(58) Field of Classification Search
USPC ..... 49/381, 383, 398
See application file for complete search history.

(56) References Cited

U.S. PATENT DOCUMENTS 772,611 A * 10/1904 Ferrara ..... 49/383
835,116 A * 11/1906 Schmidt ..... 49/398
894,754 A * 7/1908 Snaman ..... 49/33
1,326,841 A * 12/1919 Bousquet ..... 16/78
1,626,844 A * 5/1927 Kuhn ..... 160/229.1
1,949,581 A * 3/1934 Place ..... 49/398
2,309,001 A * 1/1943 Nave ..... 49/398
2,319,600 A * 5/1943 Heath ..... 49/398
2,557,716 A * 6/1951 Allee ..... 16/250
2,597,174 A * 5/1952 Patton ..... 49/398
2,910,741 A * 11/1959 Dettman ..... 49/383

(Continued)

FOREIGN PATENT DOCUMENTS

JP 2000213243 A * 8/2000

*Primary Examiner* — Katherine Mitchell
*Assistant Examiner* — Justin Rephann
(74) *Attorney, Agent, or Firm* — Michael Molins

(57) ABSTRACT

A door, frame and hinge assembly (10) includes a door (12) having a main body (24) with a hinge side defined by a convexly curved surface (14), and a frame (16, 70, 76) having a hinge side defined by a door jamb cavity (26). A hinge means (22) connects the hinge side of the door (12) to the hinge side of the frame (16, 70, 76) through a hinge pivot point (45). The convexly curved surface (14) extends beyond the location of the hinge pivot point (45) towards, and locates within, the cavity (26), so as to allow the door (12) to open without a gap being created between the hinge side of the door and the frame that may cause finger-pinch injury. The convexly curved surface (14) may be the curved surface of a cylindrical quarter segment (14*a*). The hinge side of the door (12) is formed integrally or continuously with the main body (24) of the door and extends into the door jamb cavity (26). The cavity (26) is defined at one side by the doorstop face (20) of a hinge side door jamb (16) and at the opposite side by a stationary wing (44) of the hinge means, with an innermost side of the cavity being defined by a hinge side wall stud (70).

7 Claims, 8 Drawing Sheets

U.S. PATENT DOCUMENTS

| | | | | | |
|---|---|---|---|---|---|
| 2,960,733 | A | * | 11/1960 | Nida | 49/401 |
| 2,995,785 | A | * | 8/1961 | Hallenbeck | 49/383 |
| 3,300,900 | A | * | 1/1967 | Risk et al. | 49/381 |
| 3,319,697 | A | * | 5/1967 | Krohn | 160/229.1 |
| 3,934,371 | A | * | 1/1976 | Ulatowski et al. | 49/383 |
| 3,941,180 | A | * | 3/1976 | Thill | 160/229.1 |
| 4,186,460 | A | * | 2/1980 | Artman | 16/274 |
| 4,290,233 | A | * | 9/1981 | Hubbard | 49/383 |
| 4,295,299 | A | * | 10/1981 | Nelson | 49/504 |
| 4,845,892 | A | * | 7/1989 | Pinto | 49/383 |
| 5,845,433 | A | * | 12/1998 | Walsh | 49/383 |
| 6,311,432 | B1 | * | 11/2001 | Watson | 49/383 |
| 6,578,619 | B2 | * | 6/2003 | Wright | 160/229.1 |
| 6,643,980 | B1 | * | 11/2003 | Dorder et al. | 49/383 |
| 7,861,465 | B1 | * | 1/2011 | Christ et al. | 49/506 |
| 2003/0205001 | A1 | * | 11/2003 | Williams et al. | 49/383 |
| 2004/0098916 | A1 | * | 5/2004 | Albenda | 49/383 |
| 2005/0108946 | A1 | * | 5/2005 | Shaharbani | 49/383 |
| 2008/0190029 | A1 | * | 8/2008 | Johnson | 49/383 |

* cited by examiner

CHILD SAFE DOOR, FRAME AND HINGE ASSEMBLY

FIELD OF THE INVENTION

The present invention relates to a door, frame and hinge assembly and, in particular, to a finger-pinch injury preventing assembly at the hinge side of a door.

Although the background, objects and preferred embodiments of the invention will be hereinafter described with reference to a door, frame and hinge assembly for use in buildings, it is to be understood that the invention is not limited thereto but has wider application. For example, the door, frame and hinge assembly may be used in vehicles and like mobile structures.

It is to be understood that the terminology employed herein is for the purpose of description only and should not be regarded as limiting. For instance, the terms "comprising" or "comprises" are to be understood as meaning "including", unless otherwise stated.

Also, the term "door" is to be understood as including any device, whether or not it is "door-like", that can be swung open and shut by hinges, such as hinged windows, hinged awnings and the like, and which presents a risk of finger-pinch injury to one or more fingers at the hinge side of the device.

BACKGROUND OF THE INVENTION

Doors pose many dangers to users and to others who may come into close proximity to them. If a finger or other part of the body is caught in the gap of a closing door, the injury caused may vary from minor to serious. For hinged doors, such a gap can be created between a side of the door itself and the door jamb of a frame against which the door closes. When, say, a finger is caught in the gap at the handle side of a door, the injury may involve simple bruising if the door shuts relatively slowly or may involve more serious consequences if the door is slammed shut by a person or is driven by a strong draught with high velocity. However, the injury to a finger caught in the gap at the hinge side of the door may be even more severe. Such severe injuries, which occur relatively frequently in industrialized societies, and particularly among young children in homes, schools and child care centres, may sometimes require painful reconstructive surgery, or even amputation.

A prominent part of the cause of such accidents is the design of the door itself. As a hinged door closes, the gap between the door sides and the door frame narrows. At the handle side, the door closes much faster than it does at the hinge side, but the force of impact at the hinge side is much larger.

A typical door is about 820 mm wide and 35 mm thick, or is about 23 times as wide as it is thick. This means that when the handle side of the door moves through a distance of 23 mm, the hinge side moves only 1 mm, so that any force applied at the handle side is effectively multiplied by a factor of 23 at the hinge side. Even a slight breeze blowing a door shut could cause a serious crushing injury to a finger caught in the gap at the hinge side.

The designers of typical doors and door frames seem to have ignored the implications of their design to finger-pinch injuries at the hinge side, and have rather concentrated on designs that are standardized, efficient, visually appealing and economic to construct. In the main, such doors require a frame that has a doorstop located continuously along the under side of the head jamb of the frame, and have doorstops located continuously along each of the two opposed side jambs to form a continuous, three sided doorstop face against which the top and opposed side edges of the door will close.

For wooden doors and door frames, each doorstop is typically a 60 mm wide and 12 mm thick protrusion from the main body of the frame, and the position of the doorstop face within the frame will depend on whether the door is to open inwardly or outwardly. The door can be hung on either the left or right side of the frame, and once hung it can swing in only one direction. When shut, the top and opposed side edges of the door may come into or close to contact with the doorstop face. The function of the doorstop along the side jamb nearest to which the handle side of the door shuts is important in preventing the door from swinging all the way through the frame and ripping out the hinges that hold the door to the opposite side jamb. The function of the doorstop along that opposite, hinge side jamb, however, is less important to the operation of the hung door, being useful only for sound proofing and air tightness, and it is primarily a remnant of the desire for typical door frames to be of a standardized design to adapt to having a door hung on either the left or right side of the frame, and for such doors and door frames to be visually appealing by having a consistent appearance all the way around. Its presence poses a greater problem in terms of the risk of finger-pinch injury than any functional benefit it might have. Furthermore, the hinge side doorstop, because it extends into the door cavity from the door jamb against which the side face of the door closes, acts like a vice, whereby a finger placed against the hinge side door jamb will be pinched firstly at the point along the finger corresponding to where the inner edge of the door closes towards the outer edge of the doorstop, causing an immediate cutting effect and preventing the leading part of the finger being easily pulled out from against the hinge side door jamb.

While the majority of doors are of wooden construction, there are a large number of metal doors (especially in offices and industrial buildings), where the doorstop is a metal protrusion that is about 3 mm wide (as opposed to the 60 mm wide doorstop of wooden door frames), but as with wooden frames, it is also 12 mm thick. There are three such doorstops located respectively continuously along the under side of the head jamb and continuously along the two opposed side jambs of the metal door frame. Because of the smaller width and the metallic nature of the hinge side doorstop, the cutting and trapping effects on a finger placed against the hinge side door jamb will be more severe than that for wooden door frames, acting like a bolt cutter. These problems may be exacerbated if the door has an automatic (spring loaded) return system.

Far worse consequences may arise where fingers are trapped by metal security doors, which typically have knife-like inner edges instead of the squared corner, inner edges of other doors, and so have a guillotine-like action.

There have been various attempts in the prior art to address this problem, most of which have involved add-on or retrofitted devices to doors or frames of a typical design.

For instance, door hinge guards made of plastic and rubber have been used to cover both sides of the gap created as the door is opened and into which fingers may locate between the hinge side of the door and the frame. Another approach has been to prevent the door from closing unless an obstacle (which should be child-proof, like a panic bar) has been manually removed each time the door needs to be closed. Automatic door closers, which cause the door to pause just before it shuts, have also been used.

Although functionally effective, these devices require regular maintenance and replacement from the wear and tear they experience on a daily basis. Also, they can be easily damaged or removed, and have an aesthetically poor appearance. These factors have led to generally low market penetration for these devices.

It has been found by the present inventor that none of the prior art devices and methods for preventing finger-pinch injury at the hinge side of a door are reliable over the life of the door because they can, in certain circumstances, be separated from the door or fail functionally. In time, they will suffer the wear and tear of all movable attachments to a door.

The present inventor has found that a better approach to addressing this problem is to provide a door, frame and hinge assembly that does not create a gap between the hinge side of the door and the frame as the door is opened.

Some attempts have been made in the prior art to provide arrangements of door, frame and hinge assembly that utilize complimentary shapes of surfaces between the hinge side of the door and the frame side upon which the hinges are mounted. These have usually involved having a cavity defined at the hinged side of the door and a projecting part of the frame extending beyond the location of the hinge pivot point towards, and engaging within, the cavity.

U.S. Pat. No. 2,557,716 to Allee discloses an example of one such assembly. Although that assembly prevents a gap from being created between the hinge side of the door and the frame as the door is opened up to an angle of about 90 degrees, it requires complex, prefabricated hinge members to be fitted to, and extend along the full height of, adjacent sides of the door and frame. There may also be the problem that the slender, curved guard portion of the projecting part of the frame, which needs to have at least some part of it engaged within the cavity at the hinged side of the door to prevent finger-pinch injury, may be distorted in shape as a result of misuse or impact, and no longer serve its function.

Other attempts at utilizing complementary shaped surfaces between fixed and rotating sides of structures to prevent finger-pinch injury have also not been able to allow for such prevention up to 90 degrees, or just beyond that angle for corner located doors, but have a much shorter range of protected opening, usually no more than about 60 degrees depending on the relative structures of the projecting part and the cavity. Also, many such structures relate to sectioned panel-type garage doors running up and down tracks.

The present inventor has found that an even better approach to preventing finger-pinch injury is to provide a door, frame and hinge assembly that involves having a projecting part defined at the hinged side of the door and a cavity of the frame, the projecting part of the door extending beyond the location of the hinge pivot point towards, and locating within, the cavity. He has also found that the projecting part is best defined by a convexly curved surface, which preferably should be an integral part of the door, rather than being defined by a fitting to the hinged side of the door, although such a fitting is not excluded from the present inventor's approach to addressing this problem.

SUMMARY OF THE INVENTION

It is, therefore, an object of the present invention to overcome, or at least substantially ameliorate, the aforementioned shortcomings of the prior art.

It is another object of the present invention to provide a door, frame and hinge assembly that does not create a gap between the hinge side of the door and the frame as the door is opened, in the area from which the door opens outwardly and which is very easily accessible.

It is yet another object of the present invention to provide a door, frame and hinge assembly that does not create a gap between the hinge side of the door and the frame as the door is opened, in the area into which the door opens and which is not as easily accessible, but still remains somewhat accessible.

It has been found by the present inventor that these and other objects of the invention may be achieved in general by providing a door, frame and hinge assembly comprising;

(a) a door having a main body and a hinge side defined by a convexly curved surface, (b) a frame having a hinge side defined by a cavity, and (c) hinge means connecting the hinge side of the door to the hinge side of the frame through a hinge pivot point, wherein the convexly curved surface extends beyond the location of the hinge pivot point towards, and locates within, the cavity, so as to allow the door to open without a gap being created between the hinge side of the door and the frame that may cause finger-pinch injury.

Preferably, the convexly curved surface is the curved surface of a cylindrical quarter segment.

It is preferred that the hinge side of the door is formed integrally or continuously with the main body of the door and extends into a door jamb cavity defined at one side by a doorstop face of a hinge side door jamb and at the opposite side by the hinge means, with an innermost side of the cavity being defined by a hinge side wall stud.

In a preferred form, the convexly curved surface is a quarter segment of a perfect circle.

In a further preferred form, the radius of curvature of the cylindrical quarter segment is such that, as the door opens, the convexly curved surface passes in sufficiently close proximity to the outermost edge of the doorstop face of the hinge side door jamb that a finger cannot penetrate the hinge side door jamb cavity.

The hinge means preferably comprise a plurality of vertically spaced apart hinge members.

It is also preferred that each hinge member has a movable wing which is countersunk into a planar surface of the cylindrical quarter segment.

It is further preferred that the hinge pivot point is located at the radial centre point of the perfect circle.

There has been thus outlined, rather broadly, the more important features of the invention in order that the detailed description thereof that follows may be better understood and put into practical effect, and in order that the present contribution to the art may be better appreciated.

There are additional features of the invention that will be described hereinafter. As such, those skilled in the art will appreciate that the conception, upon which the disclosure is based, may be readily utilized as the basis for designing other assemblies and methods for carrying out the objects of the present invention. It is important, therefore, that the broad outline of the invention described above be regarded as including such equivalent constructions in so far as they do not depart from the spirit and scope of the present invention.

SUMMARY OF THE DRAWINGS

The invention will be better understood and objects other than those set forth above will become apparent when consideration is given to the following detailed description thereof. Such description makes reference to the accompanying drawings, in which.

DESCRIPTION OF PREFERRED EMBODIMENTS

With reference now to the above summarized drawings of FIGS. 1 to 8, a door, frame and hinge assembly embodying the principles and concepts of the present invention will now be described.

Figure 1:
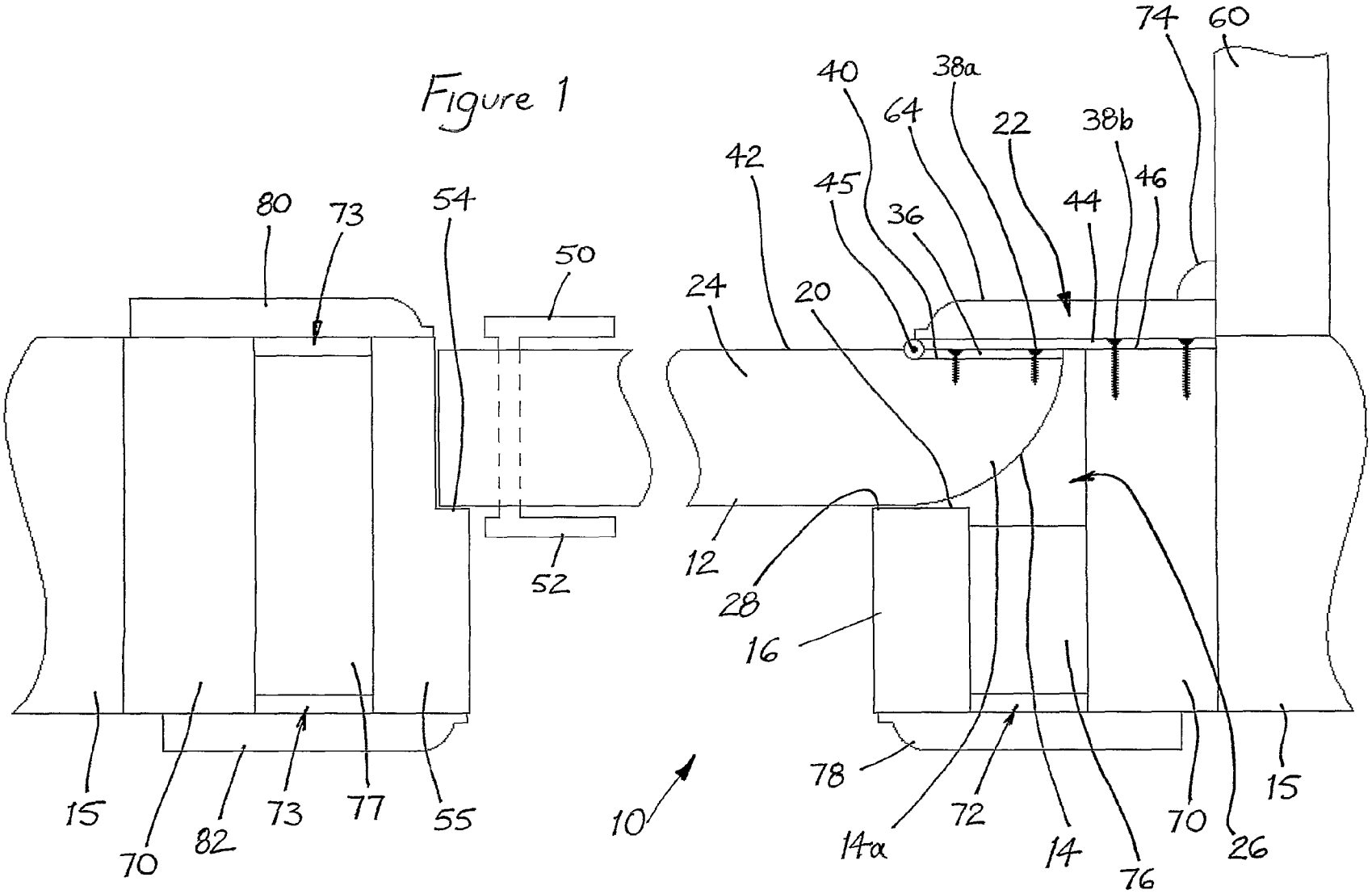
FIG. 1 is a top cross sectional view of a door, frame and hinge assembly in a closed door position according to a preferred embodiment of the invention.

The door, frame and hinge assembly 10 shown in FIG. 1 includes a door 12 having a hinge side defined by a convexly curved surface 14, a frame mounted to a wall 15, the frame being formed of a hinge side wall stud 70, vertically spaced apart packing blocks 76, and a hinge side door jamb 16. The hinge side door jamb 16 defines a hinge side doorstop face 20 of sufficient width (or of sufficient distance from the wall stud 70) to allow the door 12 to open without a gap being created between the hinge side of the door 12 and the door jamb 16 that may cause finger-pinch injury. The assembly 10 also includes hinge means 22 connecting the door 12 to the wall stud 70.

The convexly curved surface 14 defining the hinge side of the door is, in this embodiment, the curved surface of a cylindrical quarter segment 14*a*, which may also be referred to as a quarter arc extension of the door.

The hinge side of the door 12 is formed continuously or integrally with the main body 24 of the door and extends into a door jamb cavity 26 defined at one side by the face 20 of the door jamb 16 and of adjacent packing blocks 76, and at the opposite side by a part of the hinge means 22, with an innermost side of the cavity being defined by the hinge side wall stud 70.

The door hinge side has freedom of movement through the cavity, because the sides of the cavity 26, when measured along a horizontal plane, are of sufficient length relative to the door thickness to not interfere with the movement of the door.

Importantly, the convexly curved surface 14 is a quarter segment of a perfect circle.

The radius of curvature of the cylindrical quarter segment 14*a* is such that, as the door 12 opens (as shown in FIGS. 1 to 4), the convexly curved surface passes in sufficiently close proximity to the outermost edge 28 of the hinge side door jamb 16 that a finger cannot penetrate the hinge side door jamb cavity 26.

In effect, the door 12 has been enlarged over typical doors by manufacturing it with a cylindrical quarter segment 14*a* at its hinge side so that, when installed, the cylindrical quarter segment locates within the door jamb cavity 26. Any gap created between the hinge side of the door and the door jamb 16 as the door 12 opens is concealed by the door itself, and so the cavity 26 is inaccessible to fingers.

The door jamb cavity 26 is of a sufficient size to accommodate the cylindrical quarter segment 14*a* at the hinge side of the door 12. An architrave 78 covers the interior surface of the frame, but leaves a gap 72 between it and the packing blocks 76.

To accommodate these changes to the door and the frame, the hinge means connecting the door to the frame is relocated onto adjacent external surfaces of the door and frame. The hinge means, in this embodiment, comprise a plurality of vertically spaced apart hinge members, each having a pair of wings pivotally connected about a hinge pivot point, such as may be provided by a pin and barrel arrangement (see also FIGS. 5 and 6). There would be at least two hinge members for hollow core doors, and at least three hinge members for solid doors. One wing of each hinge member is preferably fixed onto the wall stud, but may alternatively be supported by some other discrete mounting structure. Although not ideal, the hinge means may alternatively comprise a single hinge member that extends from the top to the bottom of the door.

Whatever the nature of the hinge means, it should preferably distribute the load evenly over a wide area of door and frame, and the hinge means should be slim and unobtrusive. Also, the hinge pivot point should be located at the radial centre point of the perfect circle defined by the cylindrical quarter segment 14*a*.

A first, movable wing 36 of each hinge member of the hinge means is secured by a series of spaced apart screws 38*a* passing through screw holes 39*a* to a countersunk surface 40 of the cylindrical quarter segment 14*a*, the surface 40 being sufficiently deep to correspond to the thickness of the wing 36 so that the secured wing 36 is substantially coplanar to the door face 42 that faces the external direction to which the door can be opened. In this embodiment, the width of the first wing is about equal to the thickness of the door.

A second, stationary wing 44 of each hinge member, which extends a further distance from the pin 45 of the hinge member than the first wing 36, is secured by a series of spaced apart screws 38*b* passing through screw holes 39*b* to the planar face 46 of the hinge side wall stud 70 connected to the adjacent portion of wall 15, the planar face 46 being alongside the first wing 36 when the door is in a closed position. In this embodiment, the width of the second wing is about equal to twice the thickness of the door. When the door is open, one surface portion of the second wing defines one side of the hinge side door jamb cavity 26 (see FIG. 2) whilst the other remaining surface portion is screwed against the hinge side wall stud 70.

In this way, the first and second wings 36, 44 are juxtaposed in a closed pivotal position when the door is in a closed position (see FIG. 1).

The unequal widths of the wings 36, 44 of the hinge means of assembly 10, and the location of the hinge pivot point and the cavity relative to both the door and the frame are major differences over conventional door, frame and hinge assemblies. Importantly, the convexly curved surface 14 defined at the hinge side of the door 12 extends beyond the location of the hinge pivot point towards, and locates within, the cavity 26, so as to allow the door to open without a gap being created between the hinge side of the door and the frame that may cause finger-pinch injury.

Also shown in FIG. 1 is an outside or external door handle 50 and an inside door handle 52. There is a rebated doorstop face 54 on an extension of a handle side door jamb 55 of the frame. The handle side door jamb 55 is supported by packing blocks 77, and there are exterior and interior architraves 80, 82 that cover both sides of the frame, but leave gaps 73 between themselves and the packing blocks 77.

The hinge side doorstop face 20 is of sufficient width (or the outermost edge 28 is of sufficient distance from the wall stud 70) to allow a small number of extra degrees of door swing beyond 90 degrees during the opening of the door to prevent any gap being created as the door swings toward the end of the operating swing range.

An architrave 64 or trim covers the second wing 44 of each of the spaced apart hinge members, partly for aesthetic purposes, and extends from the top to the bottom of the door. Even more importantly, the architrave is of such a profile that its end extends to the pivot point of the hinge means, and thereby eliminates the possibility of a finger-pinch injury near the hinge pivot point in the area into which the door opens, irrespective of the door's position throughout its operating range. The architrave 64 also hides from view the wings of the hinge members so that the door, when closed, appears no different to conventional doors. A corner mould 74 is secured between the architrave 64 and the side wall 60.

Figure 2:
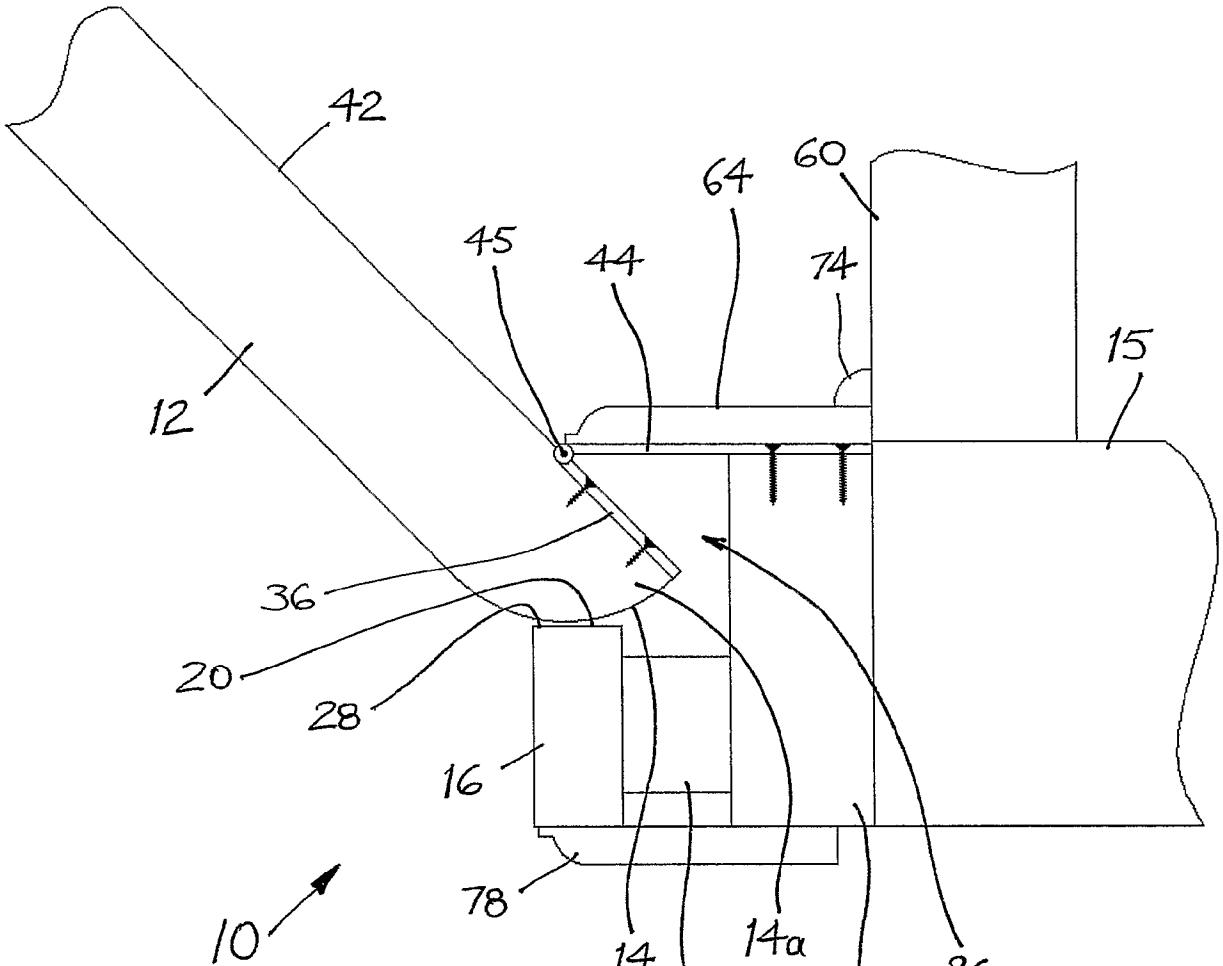
FIG. 2 is a top cross sectional view of a hinge side portion of the assembly shown in FIG. 1 in a partly open door position.
Figure 6:
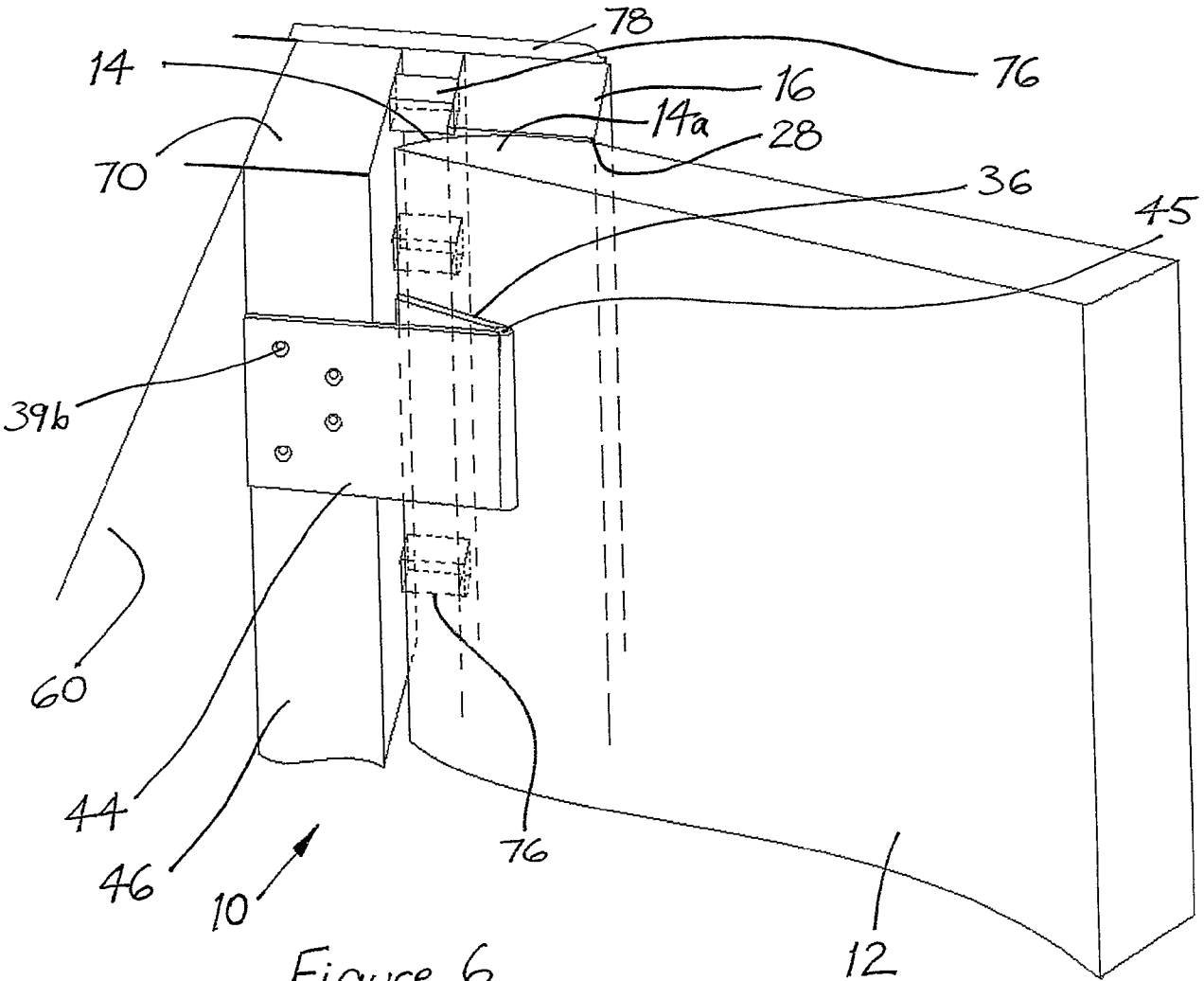
FIG. 6 is a top perspective view of an upper part of the hinge side portion of the assembly of FIG. 1 in a partly open door position, when viewed from the front of the door cavity towards which the door opens.

FIGS. 2 and 6 show the door swung partly open, and there is no gap created between the hinge side of the door and the frame, as the curved surface of the cylindrical quarter segment passes in sufficiently close proximity to the outermost edge 28 of the hinge side door jamb 16 that a finger cannot penetrate the hinge side door jamb cavity 26 in the area from which the door opens outwardly. Moreover, a finger cannot penetrate from the opposite side either.

Figure 3:
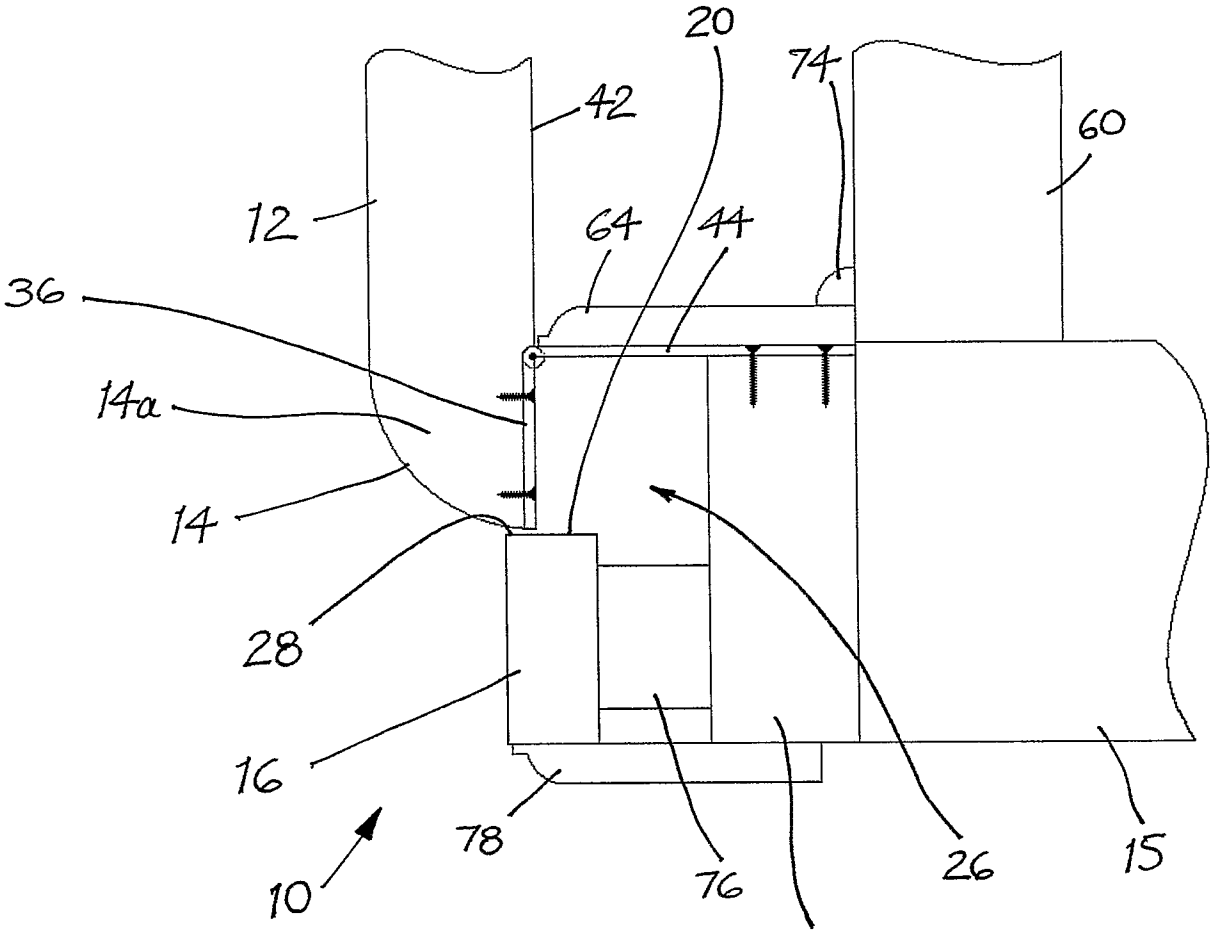
FIG. 3 is a top cross sectional view of the hinge side portion from FIG. 2 in an almost fully open position.

FIG. 3 shows the door swung open to 90 degrees, and there is still no gap created between the hinge side of the door and the frame, despite the cavity 26 being enlarged. That cavity between the cylindrical quarter segment of the door and the hinge side door jamb remains concealed. Moreover, a finger still cannot penetrate from the opposite side either.

Figure 4:
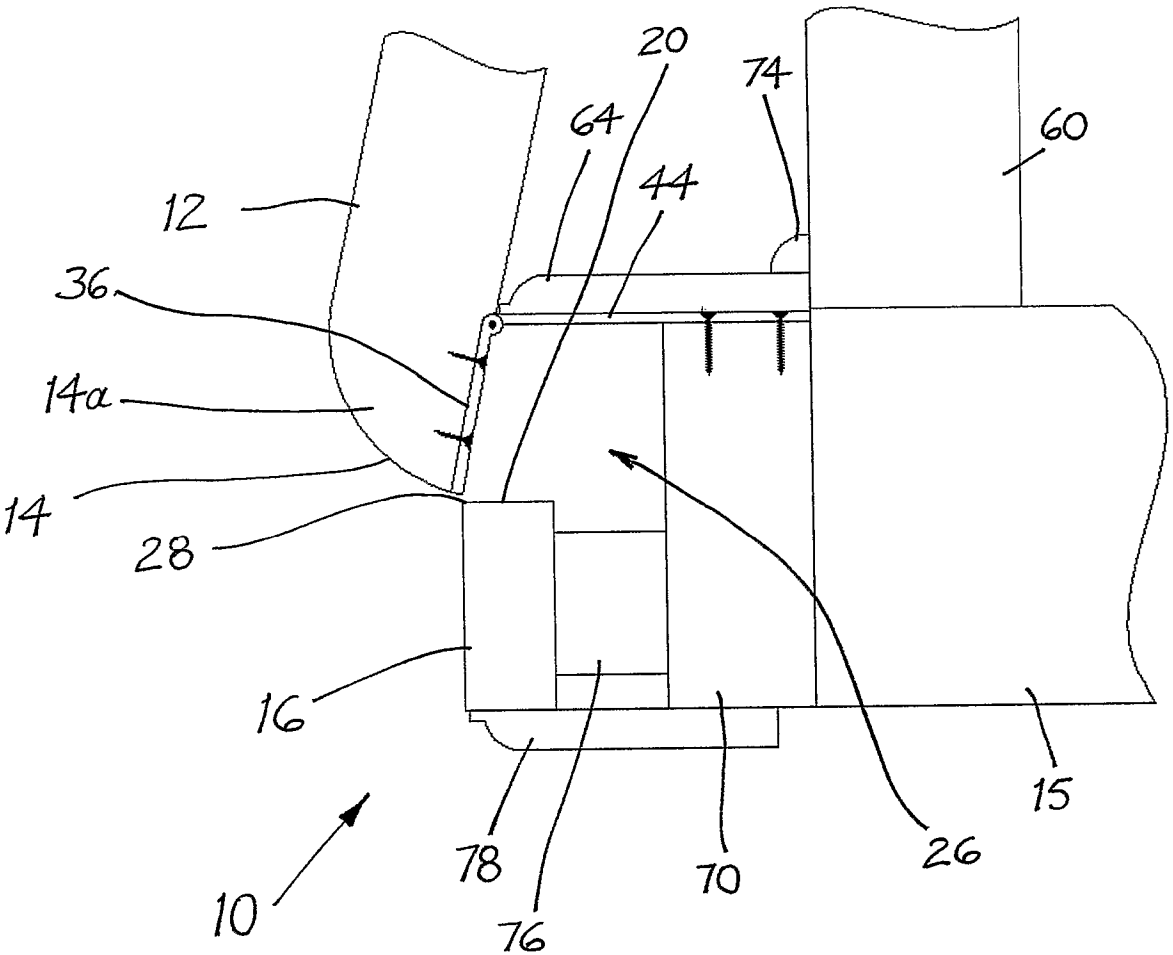
FIG. 4 is a top cross sectional view of the hinge side portion from FIG. 3 in a fully open position.
Figure 5:
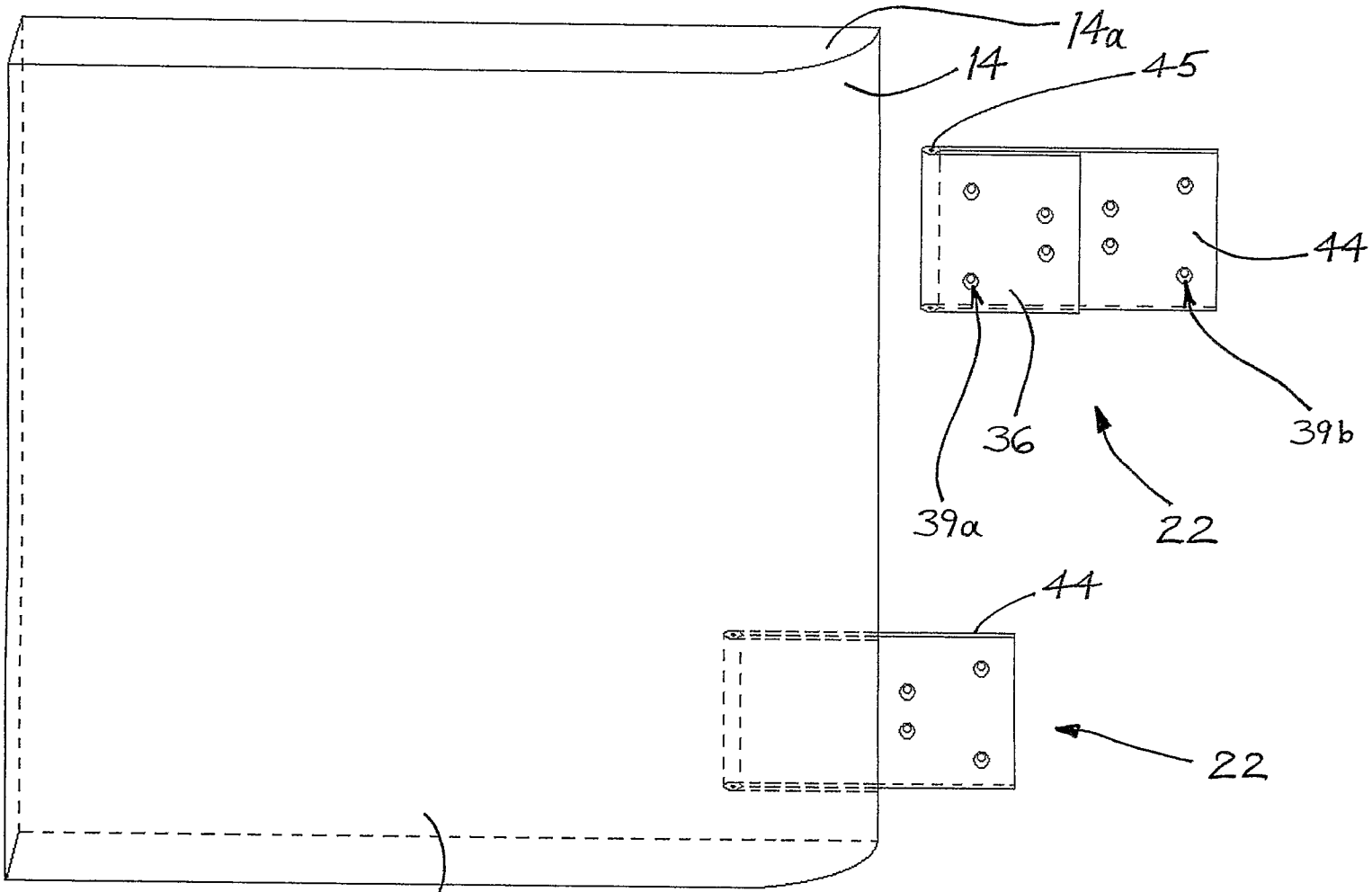
FIG. 5 is a top perspective view of a door and hinge means which are used to form the assembly shown in FIGS. 1 to 4.

FIG. 4 shows the door swung open a small number of extra degrees beyond 90 degrees to where the side wall 60 prevents any further opening of the door.

A gap is still not created between the hinge side of the door and the frame because of the location of the outermost edge 28 of the door jamb 16. Moreover, a finger still cannot penetrate from the opposite side either.

For manufacturing purposes, the main body of the door and the cylindrical quarter segment at the hinge side of the door are manufactured in one piece, such that the cylindrical quarter segment is continuous or integral with the main body. The first wing of each hinge member is then screwed against respective countersunk surfaces 40 of the cylindrical quarter segment 14*a*.

For installation purposes, the door and hinge assembly is positioned within the frame. An outer end portion of the free second wing of each hinge member is screwed against the planar face 46 of the hinge side wall stud 70 of the frame, and the inner end portion of the second wing defines one side of a hinge side door jamb cavity that is formed in the frame, with the position of the hinge pin 45 defining an approximate square with the other three corners of the cavity.

If the door is required to swing in the opposite direction, the door and hinge assembly are simply turned upside down and screwed against an opposite wall stud of the frame, so long as the cavity in that side of the frame is in the correct size and position.

For pre-hung doors and frames, the door, frame and hinge assembly is inserted into an unfinished gap of a wall at which a door is desired to be located and the wall is finished off to seamlessly meet the frame in the usual manner of construction. The architrave 64 is secured over the exposed surface of the second wing of each of the spaced apart hinge members of the hinge means.

If the door secures an area that needs to be protected from unauthorized access, the door should be assembled to the frame in such a way that the second wing of the hinge means (even if it is completely covered by an architrave) is not accessible to persons on the outside of that area. If the second wing of the hinge means were accessible to such persons, all that would be needed is for a person to remove the architrave and unscrew the second wing of each hinge member from the planar face of the hinge side wall stud. To prevent such a security breach, the door, frame and hinge assembly should be arranged so as to open inwardly into the protected area, thereby denying access to the hinge means except from within that area. If the door must open outwardly, then round headed bolts must be placed simultaneously through the second wing of each hinge member and the frame, with the round heads of the bolts being on the outside of the area and the nuts that engage the bolts being on the inside of the area.

For removal purposes, any security bolts must first be removed from inside the protected area. The architrave is removed, and the then exposed second wing of each of the spaced apart hinge members of the hinge means is unscrewed. The door and hinge assembly is then removed from the frame. If necessary, the first wing of each hinge member can be unscrewed from the door.

Figure 7:
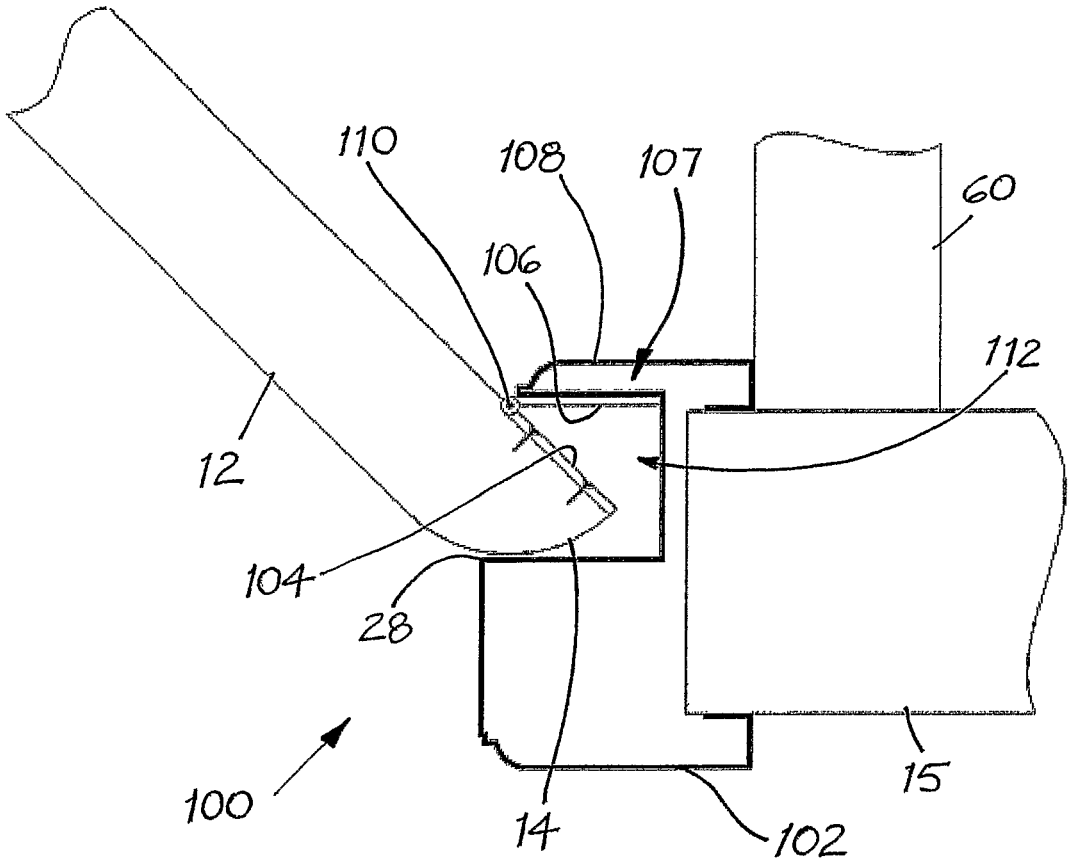
FIG. 7 is a top cross sectional view of a door, frame and hinge assembly in a partly open door position according to another preferred embodiment of the invention, the assembly using a steel frame, and the lengths of the opposed wings of each hinge member being the same.

The door, frame and hinge assembly 100 shown in FIG. 7 uses a steel frame 102 and shows a door 12 in a partly open (45 degrees) position. The lengths of the opposed wings 104, 106 of each hinge member 107 connecting the door 12 to the steel frame 102 are the same because the stationary wing 106 is secured directly to an interior "architrave-like" extension portion 108 of the frame 102.

Like assembly 10, the first and second wings 104, 106 are juxtaposed in a closed pivotal position when the door is in a closed position.

Also like assembly 10, the door 12 of the assembly 100 has a hinge side defined by a convexly curved surface 14. The steel frame 102 is mounted to a wall 15, with the frame having integrally formed stud, door jamb and exterior "architrave-like" profile portions. The door jamb portion defines a hinge side doorstop face of sufficient width (or of sufficient distance from the wall stud portion) to allow the door 12 to open without a gap being created between the hinge side of the door 12 and the door jamb portion of the steel frame.

In assembly 100, the location of the hinge pivot point 110 and the cavity 112 relative to both the door 12 and the frame 102 are major differences over conventional door, frame and hinge assemblies. Importantly, the convexly curved surface 14 defined at the hinge side of the door 12 extends beyond the location of the hinge pivot point 110 towards, and locates within, the cavity 112, so as to allow, as described above, the door to open without a gap being created between the hinge side of the door and the steel frame that may cause finger-pinch injury.

Figure 8:
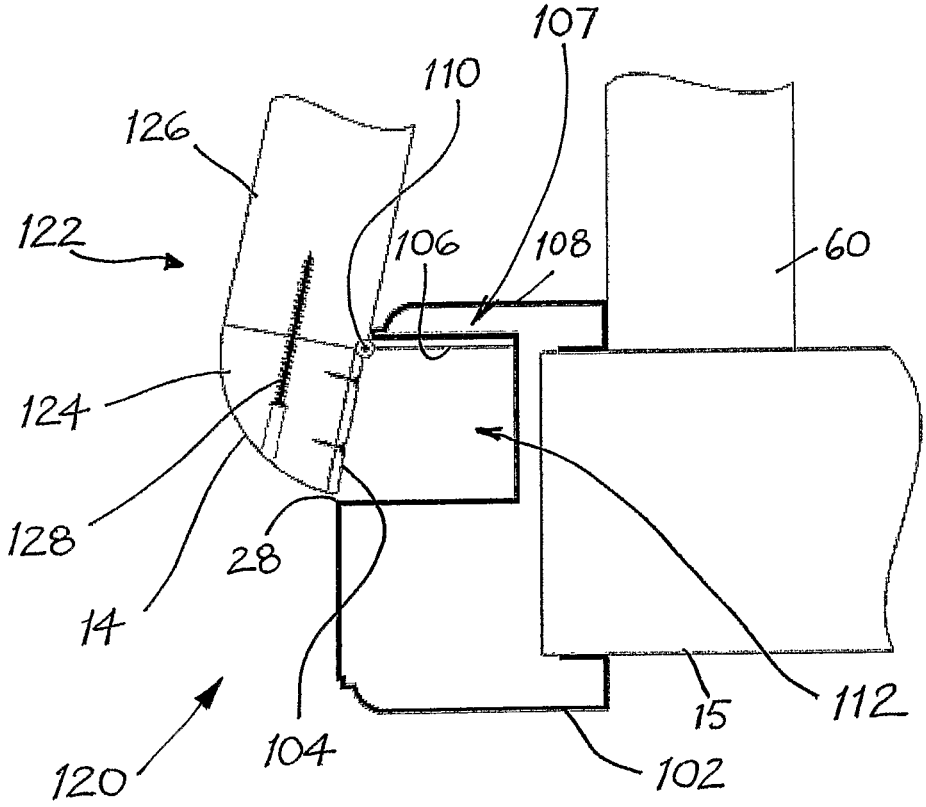
FIG. 8 is a top cross sectional view of a door, frame and hinge assembly in a fully open position according to yet another preferred embodiment of the invention, the assembly having the same steel frame and hinge members as the assembly shown in FIG. 7, but not having an integrally formed door, instead having a cylindrical quarter segment (or quarter arc extension) of the door, together with the steel frame and the hinge means, forming a mounting assembly for a conventional door, which is shown screwed to the cylindrical quarter segment.

The door, frame and hinge assembly 120 shown in FIG. 8 uses the same steel frame 102 and hinge members 107 as used in assembly 100, and shows a door 122 in a fully open position. However, the door 122 is not an integrally formed door, instead being formed from two parts. A first part is a cylindrical quarter segment 124 (or quarter arc extension) and the second part is a main body 126 of a conventional door. Screws 128 secure the cylindrical quarter segment 124 to the planar end surface of the door main body 126 to form the door 122.

Prior to hanging the door main body 126, an assembly comprising the cylindrical quarter segment 124 connected by the hinge members 107 to the steel frame 102 may be mounted to the wall.

In assembly 120, the location of the hinge pivot point 110 and the cavity 112 relative to both the door 122 and the frame 102 are major differences over conventional door, frame and hinge assemblies. Importantly, the convexly curved surface 14 defined at the hinge side of the door 122 extends beyond the location of the hinge pivot point 110 towards, and locates within, the cavity 112, so as to allow, as described above, the door to open without a gap being created between the hinge side of the door and the steel frame that may cause finger-pinch injury.

It will be readily apparent from the above description of various preferred embodiments of a door, frame and hinge assembly according to the invention that there are various advantages of such assemblies.

One advantage is that no part of a hand, and especially the fingers, can ever become trapped in a gap between the hinge side of the door and the hinge side door jamb of the frame, from either the inside or the outside of the area enclosed by the door.

Other advantages are that the means by which the assembly prevents finger-pinch injury can be an integral or continuous part of the door and the frame, and so they cannot be easily damaged or removed, and that these means can be concealed from view when the door is closed.

Yet other advantages are that the assembly will never require any maintenance and replacement despite heavy use of the door, that the assembly is reliable over the life of the door, and that the assembly is visually appealing, simple to use and relatively inexpensive. Still further advantages of the present invention will be apparent to persons skilled in the art.

The only functional limitation of the assembly described above is that it is only effective in preventing the creation of a gap between the hinge side of the door and the frame when the door is opened to a small number of degrees beyond 90 degrees. If the door were to swing open much beyond 90 degrees, the cylindrical quarter segment would exit the hinge side door jamb cavity and a gap would be created through which a finger could penetrate and suffer finger-pinch injury when the door shuts. Therefore, the assembly described above is ideally suited to installation near a corner of two walls where the door in one of the walls opens to about, or just beyond, 90 degrees against the other wall.

It will also be readily apparent to persons skilled in the art that various modifications may be made in details of design and construction of the embodiments of the door, frame and hinge assembly, and in the steps of the method using the assembly, described above without departing from the scope or ambit of the present invention.

For example, the assembly may readily use steel door frames instead of wooden door frames, and may also be used with security doors as well as fly-screen and fire-rated doors. The assembly may also have application to doors in cars and other vehicles.

The cylindrical quarter segment (or quarter arc extension) of the door, together with at least the hinge side of the frame and the hinge means, may form a mounting assembly for a conventional door, and be bricked into, or otherwise secured to, the wall opening for the door. A conventional door can then be fitted, say, by screws to the quarter segment. This would allow the door to, at a later time, be removed for repair or replacement when required, and then be refitted, without having to remove the mounting assembly. Such a mounting assembly also allows for retrofitting the present invention onto existing conventional doors.

The convexly curved surface may have a gloss paint applied to it so that it has a degree of smoothness that will minimize the small risk of the skin only of a finger being pinched.

The reference in this specification to any prior publication (or information derived from it), or to any matter which is known, is not, and should not be taken as an acknowledgement or admission or any form of suggestion that that prior publication (or information derived from it) or known matter forms part of the common general knowledge in the field of technology to which this specification relates before the priority date of this patent application.

The invention claimed is:

1. A door, frame and hinge assembly comprising;

(a) a door having a main body and a hinge side including a convexly curved surface, (b) a frame having a hinge side defined by a cavity, (c) a hinge connecting the hinge side of the door to the hinge side of the frame through a hinge pivot point, wherein the convexly curved surface extends beyond a location of the hinge pivot point towards, and is located within, the cavity, so as to allow the door to open without a gap being created between the hinge side of the door and the frame that may cause finger-pinch injury, the hinge comprising one or more hinge members, the or each hinge member having a first movable wing and a second stationary wing, wherein:

(i) the first movable wing has a planar body and is secured to a planar surface of the hinge side of the door which adjoins the convexly curved surface of the door so that it is substantially coplanar to a surface of the door that faces an external direction to which the door can be opened, and (ii) the second stationary wing has a planar body comprising a first free end portion which is secured to a planar surface of the hinge side of the frame, and a second end portion adjacent the hinge pivot point which defines a side wall of the cavity, the planar surface to which the first free end portion of the planar body of the stationary wing is secured to the frame being alongside the movable wing when the door is in a closed position.

2. The assembly of claim 1 wherein the convexly curved surface is the curved surface of a cylindrical quarter segment.

3. The assembly of claim 2 wherein the hinge side of the door is formed integrally or continuously with the main body of the door and extends into the cavity defined at one side by a doorstop face of a hinge side door jamb and at the opposite side by the hinge, with an innermost side of the cavity being defined by a hinge side wall stud.

4. The assembly of claim 3 wherein a radius of curvature of the cylindrical quarter segment is such that, as the door opens, the convexly curved surface passes in sufficiently close proximity to an outermost edge of the doorstop face that a finger cannot penetrate the cavity.

5. The assembly of claim 1 wherein the convexly curved surface is a quarter segment of a perfect circle.

6. The assembly of claim 5 wherein the hinge pivot point is located at a radial centre point of the perfect circle.

7. The assembly of claim 1 wherein the first movable wing is countersunk into the planar surface of the hinge side of the door which adjoins the convexly curved surface of the door so that it is substantially coplanar to the surface of the door that faces the external direction to which the door can be opened.

* * * * *